US008020721B2

(12) United States Patent
Skovholt et al.

(10) Patent No.: US 8,020,721 B2
(45) Date of Patent: Sep. 20, 2011

(54) TANK FOR STORING CRYOGENIC FLUIDS AND METHOD FOR CONSTRUCTING A FLUID TIGHT TANK

(75) Inventors: Otto Skovholt, Trondheim (NO); Anton Gjørven, Nesbru (NO)

(73) Assignee: Statoil ASA, Stavanger (NO)

( * ) Notice: Subject to any disclaimer, the term of this patent is extended or adjusted under 35 U.S.C. 154(b) by 1079 days.

(21) Appl. No.: 10/517,427

(22) PCT Filed: Jun. 10, 2003

(86) PCT No.: PCT/NO03/00188

§ 371 (c)(1), (2), (4) Date: Mar. 14, 2005

(87) PCT Pub. No.: WO04/001280

PCT Pub. Date: Dec. 31, 2003

(65) Prior Publication Data

US 2005/0144864 A1 Jul. 7, 2005

(30) Foreign Application Priority Data

Jun. 25, 2002 (NO) ..... 20023077

(51) Int. Cl.
*B65D 90/04* (2006.01)

(52) U.S. Cl. ..... 220/560.1; 220/560.12

(58) Field of Classification Search ..... 220/565, 220/560.1, 560.12, 560.04, 560.03
See application file for complete search history.

(56) References Cited

U.S. PATENT DOCUMENTS 3,538,661 A * 11/1970 Nelson ..... 52/246
3,559,835 A * 2/1971 Lange ..... 220/560.12
3,595,423 A * 7/1971 Yamamoto ..... 220/560.05
3,926,134 A * 12/1975 Closner et al. ..... 114/74 R
3,948,406 A * 4/1976 Papanicolaou et al. .. 220/560.15
4,069,642 A 1/1978 Hendriks
4,366,654 A 1/1983 Bomhard
4,747,513 A * 5/1988 Betille et al. ..... 220/560.12
5,586,513 A * 12/1996 Jean et al. ..... 114/74 A

FOREIGN PATENT DOCUMENTS

FR 2 349 099 A1 11/1977
GB 1 341 892 A 12/1973
NO 142144 7/1980

* cited by examiner

*Primary Examiner* — Stephen Castellano
(74) *Attorney, Agent, or Firm* — Foley & Lardner LLP

(57) ABSTRACT

The invention relates to a tank (11) for storage of cryogenic fluids. The tank (11) comprises a base section (12), a vertical wall element (14) and preferably an upper top (19). The tank (11) is provided with a fluid tight barrier (26) intended to prevent the stored fluids to escape to the surroundings. The fluid tight barrier (26) is formed of thin metal plates joined together. At least the vertical wall (14) comprises an inner structurally supporting wall element (24) and an outer structurally supporting wall element (25). The fluid tight barrier (26) is arranged between the inner (24) and the outer (25) structurally supporting wall element. The invention relates also to a method for constructing such tank (11), where the base part (12) is firstly erected whereupon a vertical wall (14) is concreted, preferably by means of slipforming or jumpforming. Firstly, the inner structurally supporting wall element (24) of the wall (14) is reinforced and concreted, whereupon a fluid tight barrier (26) is arranged on the external side of the inner structurally supporting wall element (24), whereupon the outer structurally supporting wall element (25) is reinforced and concreted.

5 Claims, 3 Drawing Sheets

TANK FOR STORING CRYOGENIC FLUIDS AND METHOD FOR CONSTRUCTING A FLUID TIGHT TANK

The present invention relates to a tank for fluid storage. Further the present invention relates to a method for building such tanks for fluid storage.

The invention relates preferably to a free-standing tank comprising a base part, a vertical wall and preferably an upper top. It should be emphasized that the fluid may also be a gas of any type or a liquid of any type. The stored products may be fluid products on a hydrocarbon basis or contaminating fluids of a type which should not be allowed to go astray. The stored fluid may also be cryogenic.

It has previously been known to use concrete tanks for storage of cryogenic fluids. Such tanks consist generally of an inner fluid tight tank surrounded by a concentrically arranged outer tank. The inner tank is supported by a support structure resting on the bottom of said outer, concentrically arranged tank. Insulation materials are arranged in the intermediate space between the inner and the outer tank. Due to its capillary proper-ties, concrete as a material is not necessarily completely tight. Further, small cracks may often appear in the concrete, either as a result of the curing process in the concreting phase or as a result of loads acting on the concrete. Hence, there is a need for securing a fluid tight wall in a different manner. It has previously been proposed to cover the inner wall of such tanks with a membrane formed by thin, steel plates joined together.

NO Patent Specification No. 310,699 describes a storage tank for cryogenic liquids, in particular liquefied gasses such as LNG. The storage tank comprises an inner tank and an outer tank where at least the inner tank is made of concrete. Heat insulation materials are placed between the side walls and bottom structure of the tank. The inner tank consists of gas tight concrete, in which prestressing cables for prestressing of the tank are installed. The cables are to be posttensioned subsequent to cooling of the tank. Further, at the exterior surface of the inner tank a liner is arranged in order to collect possible leaked liquid from the interior of the tank. Such solution requires further a pipe system for circulation of gas, installed between the liner and the exterior of the inner tank, in order gas to monitor possible leakage. Further, a pipe system for circulation of a coolant is arranged in the wall of the inner tank, whereby the tank wall can be cooled down prior to filling of LNG into the tank.

Norwegian Patent Specification No. 142,144 discloses a tank for storage of highly pollutant liquids. The tank comprises an inner tank and an outer tank of concrete. Insulation materials are placed between the inner and the outer tank wall. The wall of the outer tank is made of prestressed concrete and is further fixed to the base plate of the tank. The inner tank is made of an inner thin walled barrier in the form of thin steel plates—two elastic layers intended to compensate for possible contraction or expansion caused by temperature variances appearing when filling of LNG. A layer of insulation is further placed between the inner tank and the outer tank wall. In addition, the inner tank has a base plate formed of plates. The inner fluid tight barrier and the plates forming the base plate are made of an aluminium alloy. The inner wall is made as a non-selfsupporting thin wall structure, supported by the insulation layer, placed between the inner and the outer tank walls. A thin liquid barrier is installed on the interior side of the outer concrete wall.

GB Patent Specification No. 1,341,892 shows a storage tank for cryogenic liquids. The tank is provided with an inner concrete wall and a liquid tight steel membrane arrange outside of the concrete wall. A layer of insulation materials is placed outside the steel membrane. The exterior of the tank is covered by steel plates.

U.S. Pat. No. 4,366,654 shows a tank for storage of cryogenic fluid, consisting of an inner liquid tight tank of steel in the form of a layer of steel plates, a surrounding concrete wall having an L-shape and a layer of insulation materials arranged between the concrete wall and an externally arranged, outer wall. Inside the outer concrete wall, facing the layer of insulation materials, an insulation liner provided with an inner layer of insulation materials in the form of polyurethane foam, is arranged.

For such prior art solutions, in which the inner tank wall is made of thin plates, the thin plated part of the wall will contract heavily due to the drop in temperature during filling of LNG into the tank. A result, the thin wall will contract more than the insulation arranged outside of the thin wall. Consequently, the support of this part of the wall will be reduced and in extreme cases will be non-existent. In particular, the transition zone between the inner base plate and the inner wall will be a weak point. This may also cause cracking of the inner wall.

A further drawback with the prior art solutions is that the liquid tight thin inner wall also may be damaged, for example when exposed to forces from earthquakes, external loads, impact or the like.

A further drawback may be the cost level for construction, in particular since rigid requirements both to tightness and safety have to be met.

The object of the present invention is to provide a tank solution eliminating most of the drawbacks of the prior art solutions and at the same time achieving a cost and construction effective solution. A further object is to provide a solution which eliminates, or at least reduces, the possibilities of cracking of the liquid tight wall and/or exposure of the outer wall.

The objects are achieved inter alia by providing a wall, base plate and top structure as further defined in the claims and in particular in claim 1.

Further the objects are achieved by means of a method as further defined in the method claims.

From a principle point of view the inner wall element and the outer wall element of the inner wall is designed to take the forces acting on the wall, while the intermediate wall element forms a fluid tight barrier without substantial load carrying capacities.

When filling a cryogenic liquid into the tank the fluid tight wall element, which preferably is made of thin sheets of Ni-steel, tends to contract more than the inner concrete wall element. Hence, the inner wall element functions as a restraint for the fluid tight wall element while the fluid tight wall element exerts a prestressing force onto the inner wall element when the tank is filled with a cryogenic liquid. Further, both the inner wall element and the outer wall element function as a protection for the intermediate fluid tight wall element. The outer wall element will protect both the fluid tight wall element and the inner wall element for externally imposed forces and will in addition take pressure forces imposed by the content of the tank.

It should be noted that the tank also is suited for different other types of storages, such as storage of fluid exposed to a limited pressure, storage of environ-mental detrimental fluid, or storage of fluids having a high temperature.

Essential characteristics for the solution according to the present invention may be:

optimum use of materials minimum use of expensive materials effective exploitation of the strength of cheap materials.

A preferred embodiment of the present invention will be described in detail below, referring to the Figures wherein.

Figure 1:
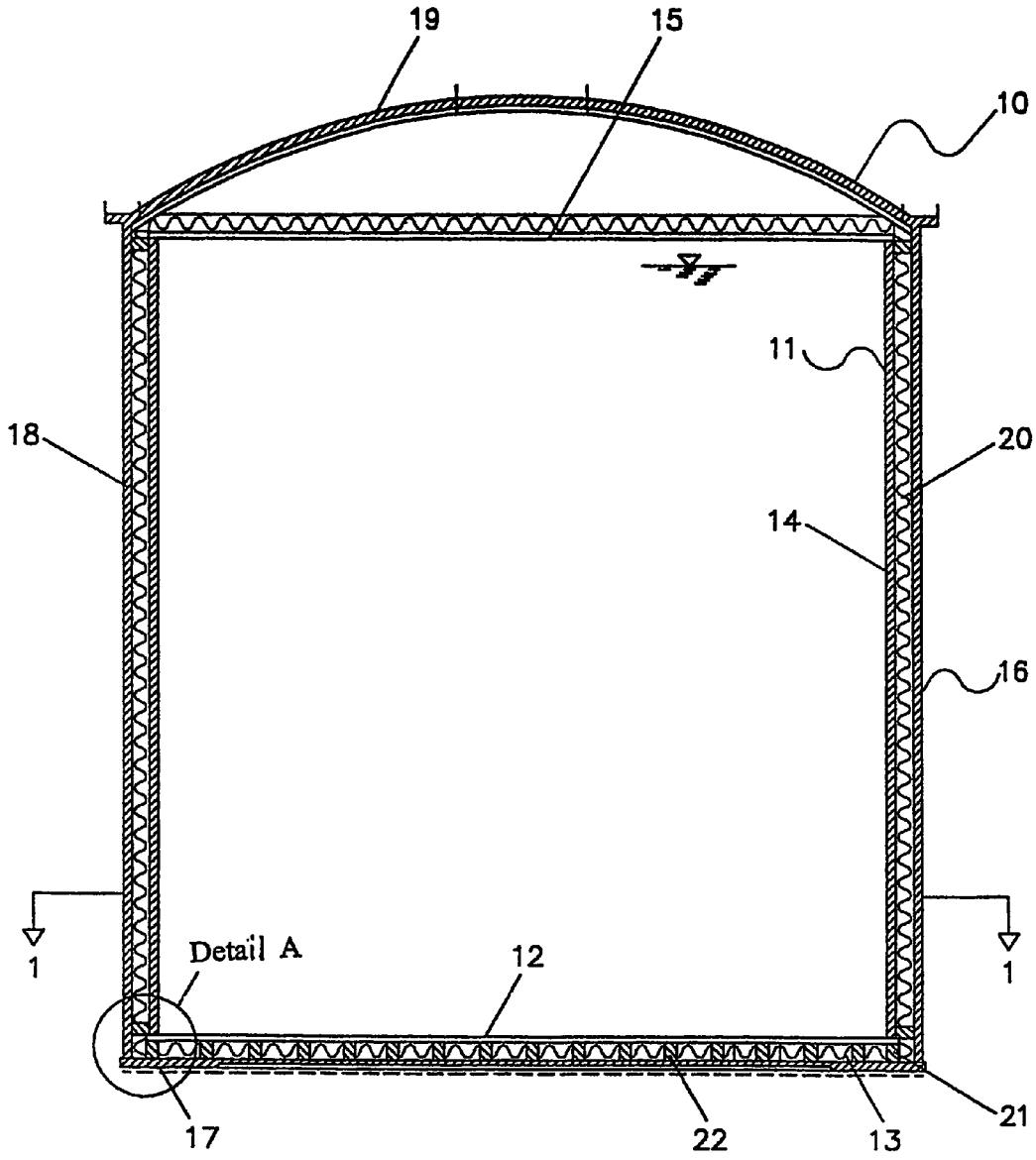
FIG. 1 shows a simplified vertical section through a tank according to the present invention, used for storage of cryogenic fluids.
Figure 2:
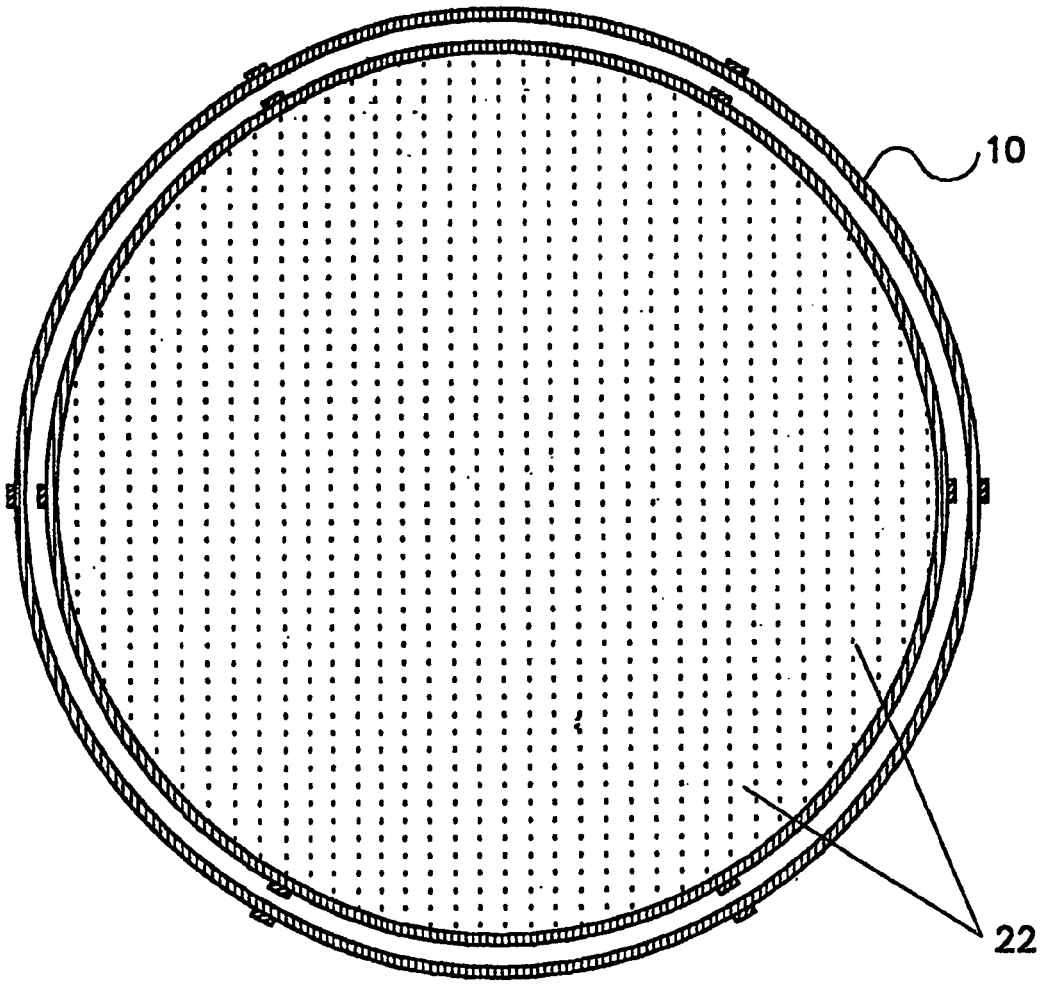
FIG. 2 shows a simplified horizontal section through the tank shown in FIG. 1, seen along the line 1-1.

FIG. 1 shows a freestanding, cylindrical tank 10, comprising an inner, fluid tight tank 11. The inner fluid tight tank 11 comprises a base plate 12 resting on a support 13. Further, the tank 11 comprises a vertical wall made of prestressed concrete and an upper top 15.

Further, the tank comprises a concentric, outer tank 16 made of prestressed concrete. The outer, concentric tank comprises a base plate 17 founded on a layer of gravel on the ground. The base plate is made of prestressed concrete. The tank 17 comprises a cylindrical concrete wall 18 extending vertically upwards, supporting a dome shaped roof 19.

The concrete plate 17, the upper dome 19 and the walls 14,18 in the inner and outer tank are reinforced, preferably prestressed.

Insulation materials 20 of any suitable type are arranged in the intermediate space between the inner tank 11 and the outer, concentric tank 16. Such insulation material may be pearlite.

The support 13 for the inner tank 11 may preferably be formed by a circumferentially arranged base 21 made of wood, the vertical cylindrical wall 14 being directly supported by the circumferentially arranged base 21. The base plate 12 of the tank 14 may for example be made of plywood and may for example have a thickness of 200 mm. The base plate 14 may be supported by a number of parallelly arranged beams 22, e.g. 2000 mm×1000 mm. Centre to centre distance for the beams 22 may for instant be 12000 mm.

On the upper side of the base plate 12 a fluid tight barrier 23 is arranged. According to the embodiment shown in FIG. 1 the fluid tight barrier 23 is made of thin steel plates having a thickness of 4 mm.

Figure 3:
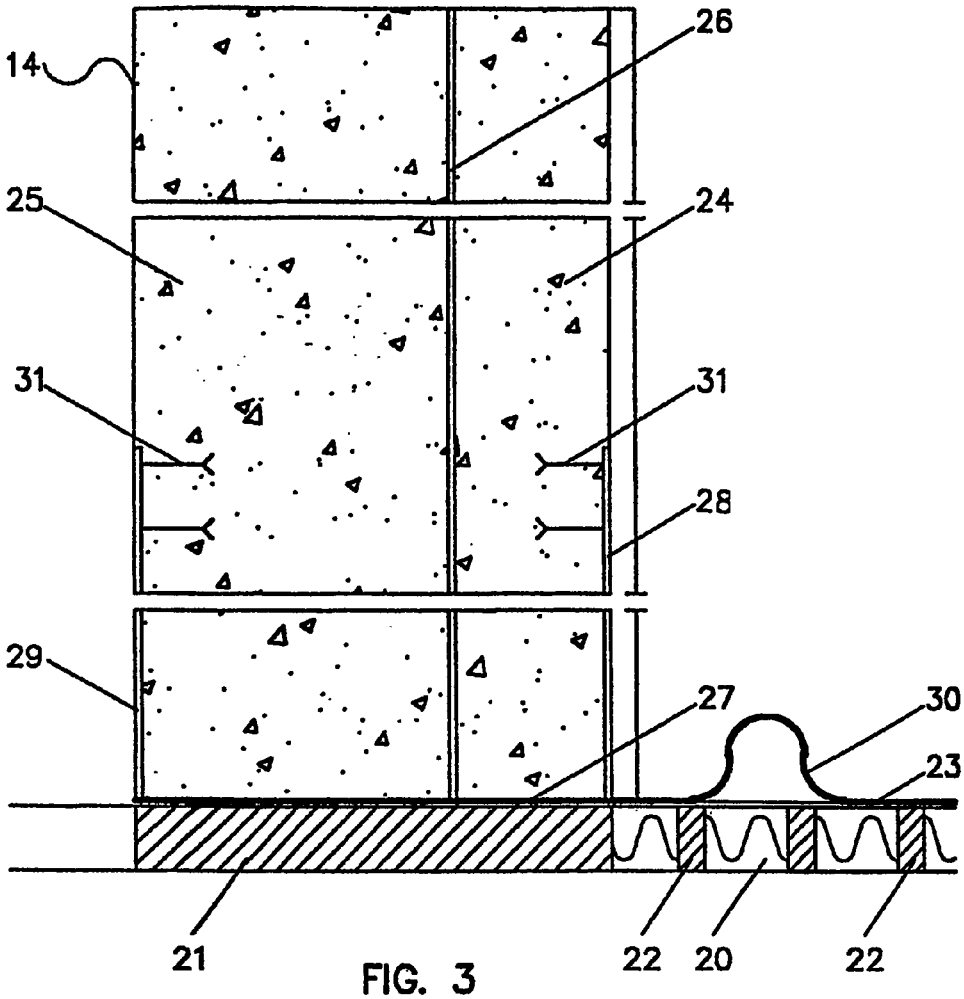
FIG. 3 shows in detail a detail A, indicated in FIG. 1.

As indicated in FIG. 1 and further shown in FIG. 3 the inner, vertical wall 14 comprises an outer 25 and inner 24 structurally supporting wall element and an intermediate fluid tight barrier 26. The intermediate fluid tight barrier 26 is joined with the fluid tight barrier 23 resting on the tank base plate 12. Said joint is also made fluid tight.

The fluid tight barrier 26 may for example be made of thin plates joined together along the plate edges to form a fluid tight joint. The joint may be made in any suit-able, conventional manner. The edges of the metal plates may for example be bent up and the upper end of the edges of the metal plates may then be bent and folded together. Alternatively and/or in addition the edges may be welded together. Dependent upon the choice of material the plates may optionally be glued together. In the latter case it may suffice to let the plates partly overlap and then apply glue.

FIG. 3 shows in detail a section at the lower end of the wall 14 in the inner tank 11. The vertical wall 14 rests on a ring formed beam 21, preferably made of wood. At its lower end the vertical wall 14 is provided with a horizontal metal plate, preferably steel. The steel plate extends into the inner tank 11 and is via an expansion loop 30 connected fluid tight to the fluid tight barrier 23, resting on the tank base plate 12. As specified above the vertical wall 14 comprises an inner structurally supporting wall element 24 and an outer structurally supporting element 25. A vertical fluid tight barrier 26, fluid tightly joined with the plate 27 forming the lower end of the vertical wall 14, is arranged between said wall elements as an integral part of the vertical wall 14. In order to secure adequate transfer of forces from the base plate 12 to the vertical wall 14, for example caused by contraction of the tank due to cooling the content down to cryogenic temperatures, vertical ring shaped plates 28,29 made of metal are welded to the lower plate 27. At least at their upper end of the plates 28,29, securing embedment means 31 are, arranged in order to secure transfer of loads and forces into the concrete wall. Said embedment means 31 may preferably be arranged at different vertical levels.

Ductility and fluid tightness are the most important properties of the intermediate fluid tight barrier 26. In particular ductility is very important if the fluid to be stored is cryogenic. The fluid tight barrier 23,26 should be made of a material which may withstand the fluid to be stored. The types of material may for example be metal plates, for instant made of Ni-steel, plastic materials in the form of films, membranes in the form of epoxy, etc.

Figure 4:
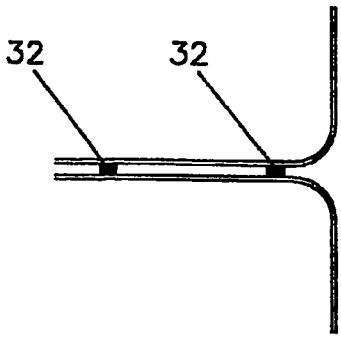
FIG. 4 shows a way of welding two adjacent edges of adjacent steel plates, for formation of a fluid tight barrier.
Figure 5:
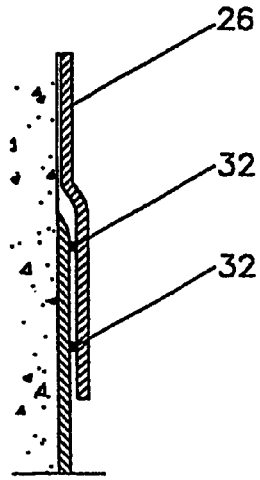
FIG. 5 shows a preferred method for welding together the edges on adjacent steel plates.

FIG. 4 shows a preferred way of establishing a fluid tight joint between two adjacent steel plates. The side edges are bent upwards and welded together at two different levels by means of a continuous, fluid tight welding seam 32.

Correspondingly the outer tank comprises a base plate and vertical walls. At its upper end the tank is equipped with a roof structure, for example in the form of a dome or a truncated cone.

The function of the inner structurally supporting wall element 24 is to protect the membrane from loads and impacts from the stored fluid and also to form support for the membrane, in particular when the fluid is cooled down to cryogenic temperatures. The outer structural part 24 shall in particular take up loads and forces and should consequently be prestressed. The wall should in addition preferably be ordinary, non-prestressed, reinforced.

Dependent upon the fluid to be stored, the membrane or the intermediate fluid tight barrier 26 may be formed of plastic materials, such as plastic sheets or a layer of epoxy.

The outer tank 16 may also be equipped with a vapour barrier of a thin plated material. The vapour barrier may be arranged and fixed on the interior wall of the outer tank 16 in any known manner. In an alternative embodiment the wall of the outer tank 16 may be constructed more or less in the same manner as the wall of the inner tank 11, thereby providing a inner layer of concrete, surrounded by a thin plated fluid tight barrier, applying the same principles as described above. The outer layer is then concreted and prestressed. It would be preferable if the concreting of the inner tank wall and the outer tank wall are performed in the same slipforming operation, although at sufficient different levels to enable mounting the intermediate metal plates.

A preferred method of construction of a fluid tight tank of prestressed concrete for storage of fluids, preferably cryogenic fluids, will be described below. According to such embodiment the tank comprises in any case an inner fluid tight tank made of prestressed concrete, for example as described above. The inner tank comprises a base, a vertical wall of concrete and preferably an upper top.

Firstly, a footing is constructed whereupon the foundation of the tank is constructed. A vertical wall structure 24 is then concreted, preferably by means of slipforming or jumpforming. The first stage in this process is to erect the formwork for the inner structurally supporting element on said foundation, whereupon an inner structurally supporting element 24 is reinforced and concreted. Then the fluid tight barrier 26, arranged on the exterior of said inner structurally supporting element 24 is installed whereupon the outer structurally supporting element 25 is reinforced and concreted.

The lower part of the wall is erected on a foundation, the lower part of which comprises a base plate 27 of steel, an inner and outer steel plate 28,29 extending along the inner and outer circumference of the wall and fixed by means of welding with the horizontal base plate 27. Further, the lower end of the intermediate thin plated fluid tight membrane 26 in the form of steel plates are fixed by welding to said horizontal base plate whereupon this part of the wall is reinforced an concreted.

Preferably, both the inner and the outer structural supporting wall elements 24,25 are concreted by means of slipforming or jumpforming.

According to an embodiment the inner structurally supporting wall element 24 is concreted at least partly up to a level prior to starting the process of installing the intermediate fluid tight barrier 26, whereupon the intermediate fluid tight barrier 26 is installed at least partly up to a level prior to starting the process of reinforcing and concreting the outer structurally supporting wall element 25.

The intermediate fluid tight barrier 26 may according to an embodiment be formed of thin steel plates in the form of long sheets, delivered on spools. Said sheets are wound in a helical pattern around the exterior of the inner structurally supporting wall element, adjacent edges of the sheets being welded together to form a tight barrier. The start of the wounding and welding process of the steel sheets may start when concreting of the inner supporting wall elements has reached a certain height. Since it is expected that the welding process will require longer time that the slipforming process, it is convenient to postpone the start of slipforming or jumpforming of the outer structural supporting wall element until the welding process of the steel sheets more or less is completed. It should be appreciated that any stop in such concreting process should be avoided, since such stop would require a stop-joint.

According to the embodiments above the structurally supporting elements of the inner wall is made of reinforced concrete. It should be appreciated, however, that that said portions may be made of a different material, e.g. in the form of a load supporting wooden structure.

Further it should be noted that the tank may have a different cross sectional shape than the circular shape shown and described in connection with the drawings.

In case the stored fluid is not cryogenic, an outer tank 16 may not be required. The tank may also have other geometrical shapes than the cylindrical shape.

Concrete as referred to in this description, may comprise reinforced (conventional non-prestressed) concrete, prestressed and/or posttensioned concrete. Also multi-axially prestressed concrete is included in this definition.

In the disclosed embodiment a cylindrical tank for storage of cryogenic fluid is shown. It should be appreciated, however, that the tank may be used for storage of other types of fluids, such as environmentally detrimental fluids to be prevented from escaping to the environment, fluids exposed to pressure and/or fluids subjected to high temperatures.

It should further be noted that the invention is not limited to tanks having a cylindrical shape. The tank may as such have any suitable shape.

Further, the tank may not necessarily only be used for storage of fluids. A tank according to the present invention may also be used as a room for implementing processes and/or carrying out reactions.

The joint between the vertical part of the fluid tight wall element and the corresponding base plate may have any suitable shape preventing formation of cracks or rupture in the joint.

The fluid tight wall element 26 may according to the described embodiment be made of Ni-steel or an alloy of several metals. It should be noted, however, that such material may be of any suitable type. It is of importance, however, that that the choice of material is such that the material is both ductile and fluid tight and made of a material which may withstand the fluid to be stored in the tank.

In the disclosed embodiment the tank is made of two concentrically arranged separate tanks. It should be noted that the invention is not limited to two concentric tanks, but may just as much be formed as a single tank. The need for insulation depends on the intended use and the temperature of the fluid to be stored and/or the ambient temperature.

The embodiment shows a large tank. Also smaller volumes, e.g. down to 30 $m^3$ may be suited.

Further, the embodiment discloses a tank having an inner and outer wall element 24,25 made of concrete. It should be noted that at least one of said two wall elements may be formed by a different material, such as e.g. wood.

REFERENCE NUMBERING LIST

10 Free-standing tank
11 Inner fluid tight tank
12 Base plate
13 Foundation for the inner fluid tight tank
14 Vertical tank wall
15 Upper top
16 Outer tank
17 Base plate in outer tank
18 Cylindrical wall in outer tank
19 Dome shaped calotte
20 Insulation
21 Ring shaped base for support of the inner tank wall
22 Wooden girders form the foundation for the inner tank
23 Fluid tight barrier on the base plate of the inner tank
24 Inner structural supporting wall element of the inner tank wall
25 Outer structural supporting wall element of the inner tank wall
26 Intermediate fluid tight barrier in the inner tank wall
27 Steel plate arranged at the lower end of the inner tank wall
28 Lower, inner, vertical, ring shaped steel plate
29 Lower, outer, vertical. Ring shaped steel plate
30 Expansion joint
31 Anchorage means
32 Fluid tight, continuous weld seam

The invention claimed is:

1. A tank assembly adapted to store cryogenic fluids, comprising a tank having a base plate and a vertical wall, the tank being provided with a fluid tight barrier preventing stored fluids from escaping out of the tank, wherein the vertical wall comprises an inner structurally supporting wall element made of concrete, an outer structurally supporting wall element made of concrete, and an intermediate fluid tight barrier comprising a membrane interposed between the inner structurally supporting wall element and the outer structurally supporting wall element, wherein an inner surface of the intermediate fluid tight barrier comprises a membrane that is in direct contact with an outer surface of the inner structurally supporting wall element such that the assembly of the intermediate fluid tight barrier and the inner wall element is adapted to restrain the membrane of the intermediate fluid tight barrier from contracting in a radial direction inwards when the tank is filled with the cryogenic fluids, wherein the structurally supporting wall elements and the intermediate fluid tight barrier together form a compact, structurally integrated and fluid tight wall, and wherein the vertical wall, at its lower end, is terminated by a horizontal metal plate and inner and an outer vertical steel plates extending along an inner and outer circumference of the vertical wall, the vertical steel plates being welded to the horizontal metal plate.

2. The tank of claim 1, wherein the inner vertical steel plate is secured to the inner structurally supporting wall element of the inner wall and rigidly fixed to the horizontal metal plate, and the outer vertical steel plate is secured to the outer structurally supporting wall element.

3. The tank of claim 2, wherein the inner and outer vertical steel plates are adapted to transfer forces from the horizontal metal plate to the outer structurally supporting wall element caused by different contraction of elements of the inner wall of the tank due to cooling caused by filling of cryogenic fluid into the tank.

4. Tank according to claim 1, wherein the fluid tight barrier is in direct contact with an inner surface of the outer structurally supporting wall element.

5. Tank according to claim 1, wherein the membrane interposed between the inner structurally supporting wall element and the outer structurally supporting wall element is made of steel or plastic material.

* * * * *